United States Patent [19]

Fisk

[11] 4,300,481

[45] Nov. 17, 1981

[54] SHELL AND TUBE MOISTURE SEPARATOR REHEATER WITH OUTLET ORIFICING

[75] Inventor: Robert W. Fisk, Cape Elizabeth, Me.

[73] Assignee: General Electric Company, Schenectady, N.Y.

[21] Appl. No.: 102,796

[22] Filed: Dec. 12, 1979

[51] Int. Cl.[3] ..... F22G 3/00; F28B 9/00; F28F 9/02

[52] U.S. Cl. ..... 122/406 B; 122/483; 165/111; 165/174

[58] Field of Search ..... 165/174, 114, 110, 111, 165/112, 113; 122/483, 488, 406 B, 441

[56] References Cited

U.S. PATENT DOCUMENTS

| | | | |
|---|---|---|---|
| 553,841 | 2/1896 | Cooper | 122/406 B |
| 1,684,083 | 9/1928 | Bloom | 165/174 |
| 2,296,426 | 9/1942 | Coutant | 122/406 B |
| 2,310,234 | 2/1943 | Haug | 165/174 |
| 3,073,575 | 1/1963 | Schulenberg | 165/174 |
| 3,612,172 | 10/1971 | Dohnt | 165/114 |
| 3,710,854 | 1/1973 | Staub | 165/174 |
| 3,759,319 | 9/1973 | Ritland et al. | 165/111 |
| 3,830,293 | 8/1974 | Bell | 165/174 |
| 3,996,897 | 12/1976 | Herzog | 122/483 |
| 4,106,559 | 8/1978 | Ritland et al. | 122/483 |
| 4,153,106 | 5/1979 | Sonoda et al. | 165/174 |
| 4,166,497 | 9/1979 | Coit | 165/111 |

*Primary Examiner*—Sheldon J. Richter
*Attorney, Agent, or Firm*—John F. Ahern

[57] ABSTRACT

Shell and tube heat exchangers achieve greater efficiency and substantially eliminate instabilities due to condensate subcooling by the location of flow restricting orifices at the outlet ends of heat exchanger tubes adjacent to the outlet header. Outlet orificing preferentially passes liquid condensate so as to prevent accumulation of condensate within the tubes and permits a higher tubeside temperature, even in the most heavily loaded tubes. In a two-pass configuration all tubes are outlet orificed. In a four-pass system, the most heavily loaded tubes (second pass) are orificed, although all tubes may be outlet orificed. Outlet orificing may be used in conjunction with inlet orificing which is used to provide greatest mass flow of tubeside steam to most heavily loaded tubes. Outlet orificing may be used in connection with vertical or horizontal U tube configurations. Preferred embodiment is utilized in a moisture separator reheater for use with steam turbines to reheat steam for later turbine stages. Orifices are restricted diameter apertured plugs in heat exchanger tubes located within the tubesheet adjacent to the header.

12 Claims, 7 Drawing Figures

FIG. 1.
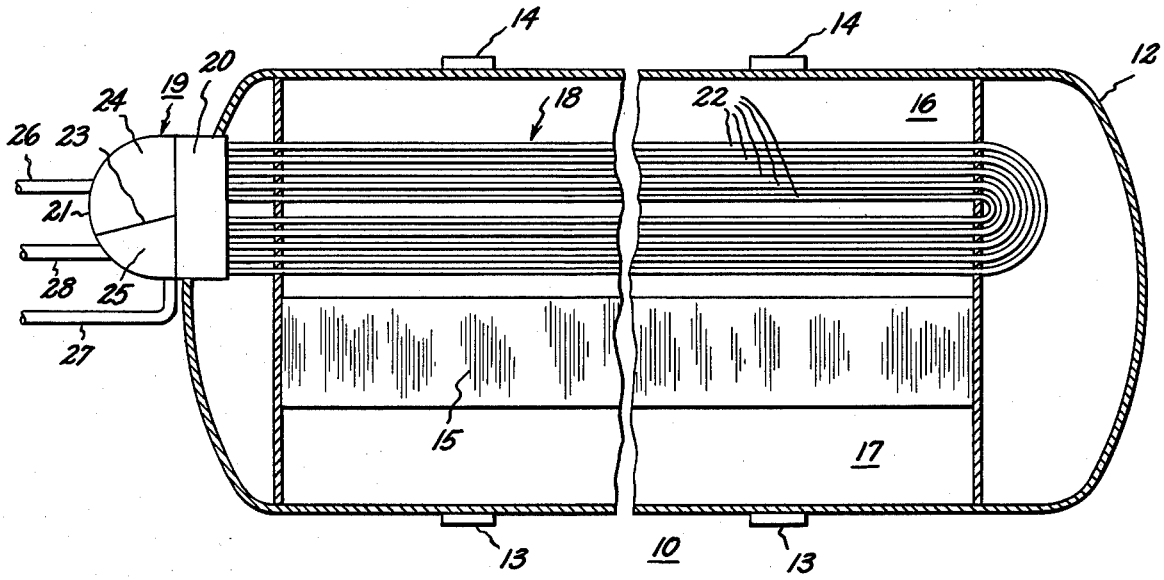
FIG. 2.
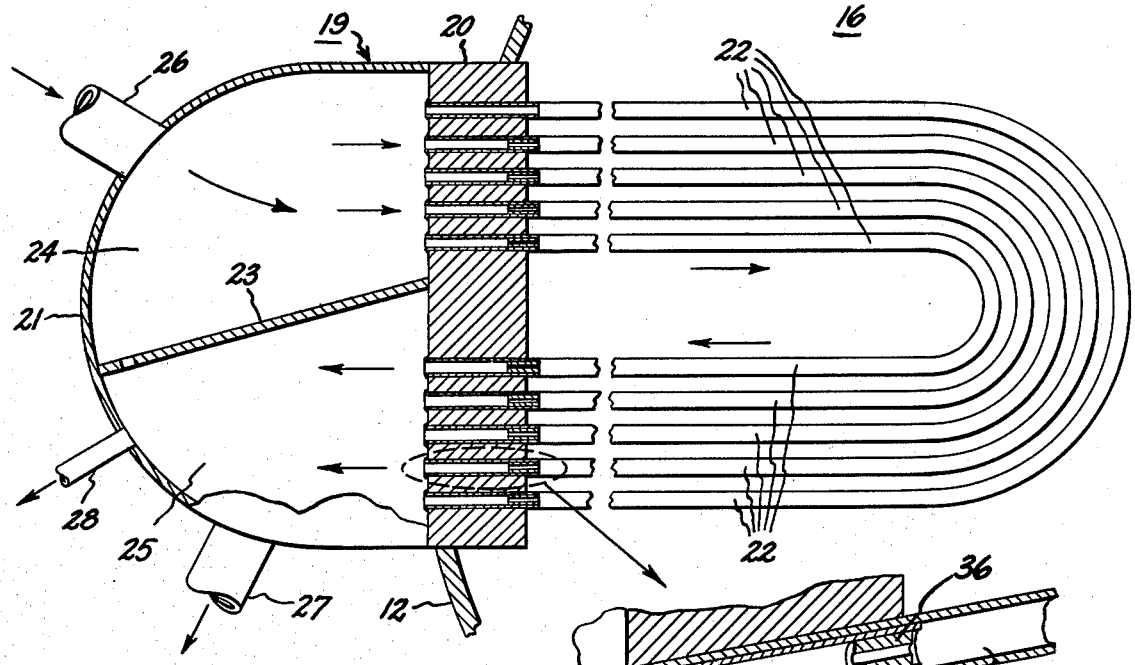
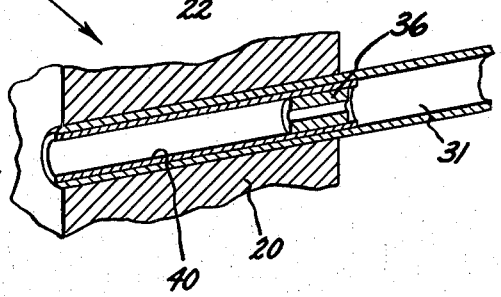
FIG. 3.

SHELL AND TUBE MOISTURE SEPARATOR REHEATER WITH OUTLET ORIFICING

The present invention relates to shell and tube heat exchangers and more particularly to heat exchangers of the shell and tube type in which at least some of the tubes of the heat exchanger have their effective diameters reduced by a technique known as "orificing" in which restricted diameter orifices are inserted into end portions thereof to improve the flow of heating fluid therethrough.

BACKGROUND OF THE INVENTION

Shell and tube reheaters, wherein a first fluid enters a first or inlet section of a header and after a single, double, or multiple number of passes exits into a second or outlet header section, suffer from a variety of problems which contribute to inefficiencies and instabilities in their operation.

One such type of heat exchanger is a moisture separator reheater, used with a steam turbine to reheat moist saturated steam which is exhausted from a first turbine section before it is input to a second turbine section. In the operation of such moisture separator reheaters (MSRs) the apparatus comprises one or more reheater tube bundles disposed in series arrangement between the inlet and outlet ports of the shell and a moisture separator for removing entrained moisture from the input shellside steam as it passes into the shell. The present invention is directed to improved structure for a reheater section such as may be a portion of an MSR.

The problems encountered in MSRs, reheaters and other shell and tube heat exchangers are set forth in detail in U.S. Pat. (Application Ser. No. 890,674 filed Mar. 27, 1978 and assigned to the present assignee) to Reed et al. now U.S. Pat. No. 4,206,802, the disclosure of which is incorporated herein by reference thereto.

Briefly stated, the more serious problems with respect to MSRs and reheaters, with respect to which the invention will be discussed, although it is not limited in application thereto, relates to the subcooling of condensate from tubeside steam in certain of the reheater tubes.

Subcooled condensate tends to introduce instabilities. These instabilities stem from the condition that all tubes of the reheater involved in a given shellside steam pass are in parallel and exit to the same outlet header and, in the case in which the pressure in the outlet header may be temporarily greater than the driving force behind subcooled condensate, difficulty of draining of tubes and other attendant instabilities frequently result.

A solution to the problems described is to flush or "scavenge" the tubes of the heat exchanger with excess steam over that required to heat shellside steam. Still another technique used is to "orifice" the tube inlets to provide for different size entrance apertures for the respective tubes with the more heavily loaded tubes having the greatest aperture while the most lightly loaded tubes have the smallest entrance apertures. Since the respective tubes receive heating steam in proportion to the size of the entrance aperture, differential orificing tends to supply a greater mass flow of steam to the more heavily loaded tubes to facilitate a better distribution of steam supplied to these tubes and thus greatly reduce condensate subcooling and associated instabilities.

While the foregoing features are effective to reduce instabilities in MSR tube bundles, further changes in the shell and tube structure thereof are required to reduce the amount of scavenging steam necessary to control subcooling and thus increase the thermal efficiency of the reheaters. Additionally further means are required to further reduce and eliminate condensate subcooling and attendant instabilities.

In the aforementioned Reed et al patent the use of a high $\Delta P$ thermocompressor is employed to improve the efficacy of scavenging with a given excess quality of scavenging steam. The present application achieves these and additional improvements in a less complicated manner.

Accordingly, it is an object of the invention to provide improved heat exchangers of the shell and tube type which avoid instabilities due to condensate subcooling.

Another object of the present invention is to provide improved shell and tube heat exchange reheaters which avoid condensate subcooling and associated instabilities without a loss of efficiency.

Yet another object of the invention is to accomplish the foregoing objects with a minimum of change in reheater configuration and at the least cost and with the best possible efficacy.

SUMMARY OF THE INVENTION

Briefly stated, in accord with a preferred embodiment of this invention a reheater for a shell and tube heat exchanger includes a plurality of tubes for passing a first heating fluid in heat exchange relationship with a second fluid to be heated, an inlet chamber for supplying the first heating fluid in fluid flow relationship with at least some of the tubes, and an outlet chamber in fluid flow relationship with at least some of the tubes, and orificing means in the outlet end of those tubes in fluid flow relationship with the outlet chamber.

BRIEF DESCRIPTION OF THE DRAWINGS

The novel features believed characteristic of the invention are set forth in the appended claims. The invention itself, together with further objects and advantages thereof, is more particularly described in the following detailed description, taken in conjunction with the accompanying drawings in which:

FIG. 1 is a vertical cross-sectional schematic view of a moisture separator reheater embodying a shell and tube heat exchanger in accord with the present invention;

FIG. 2 is a vertical cross-sectional view, with parts broken away, of a reheater tube bundle assembly of the apparatus of FIG. 1;

FIG. 3 is an enlarged sectional view of a portion of one tube of FIG. 1 showing the details of an outlet orifice;

FIG. 1 illustrates in partially broken away vertical cross-sectional view a shell and tube type reheater specifically adapted as a moisture separator reheater for use with a steam turbine. Although this invention is not limited to moisture separator reheater structures, the invention will be described with respect thereto for convenience and conciseness and to describe the relationship of a preferred embodiment thereof with a specific operative unit, e.g., a steam turbine.

In FIG. 1 a moisture separator reheater 10 includes a shell 12 having a pair of inlet apertures or openings 13 for receiving moist saturated steam from the exhaust of the first stage of a steam turbine and a pair of apertures or openings 14 for discharging from shell 12 dry superheated steam which may be used to supply motive power to a second stage of a steam turbine.

Figure 4:
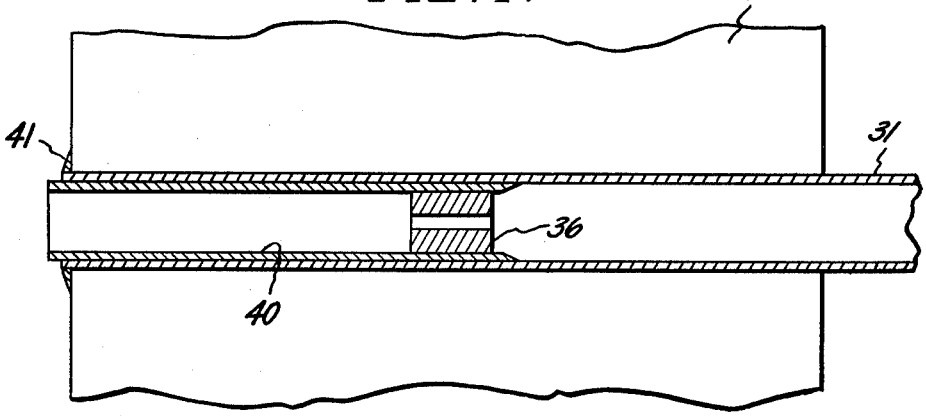
FIG. 4 illustrates in detail a tube orifice apparatus including a tube insert and an orifice such as is shown in FIG. 3.

Immediately disposed over and in close relationship to apertures 13 a moisture separator means 15 is disposed for the physical separation for entrained moisture which may be included within steam input through apertures 13. Moisture separator 15 generally comprises a plurality of angularly disposed "wiggle plates" or vanes which physically separate entrained moisture by the impingement of moisture thereupon and draining therefrom to a moisture drain, not shown. The structure of such vanes is well known to the moisture separator arts and need not be discussed herein.

Shellside steam is input through apertures 13, and, after passing through moisture separator 15, impinges upon and passes through a reheater 16 which includes a tube bundle 18, a header assembly 19 including a tubesheet 20 and a partially spherical or cylindrical header member 21. A plurality of heat transfer tubes 22, in this instance having a U-shaped configuration and arranged in a vertical plane are connected through tubesheet 20 to header member 21 which is separated into an inlet header chamber 24 and outlet header chamber 25 by pass-partition plate 23. The structure of the tubesheet and the interconnection between the heat transfer tubes and the inlet and outlet header chambers 24 and 25, respectively, are illustrated in further drawings and will be discussed hereinafter.

In operation, hot saturated steam, for example throttle steam, is input to inlet header chamber 24 through pipe 26 and passes into the heat transfer tubes 22 connected thereto, transverses the vertical U-bend configuration of heat transfer tubes 22 and discharges into outlet header chamber 25. At the same time shellside steam is entering shell 12 through aperture 13, passing in heat-transfer relationship between and around heat-transfer tubes 22 and is exiting from shell 12 at apertures 14. During such passage the temperature of the shellside steam is increased and the steam becomes heated and superheated by removing heat from tubes 22 containing saturated steam, resulting in a phase change of a portion of the tubeside steam so that a mixture of liquid condensate and steam is input to outlet header chamber 25 from the returning ends of heat-transfer tubes 22. The liquid condensate is removed from outlet header chamber 25 through drain pipe 27 and vapor or steam input to the outlet header chamber 25 is removed therefrom through vent pipe 28.

The structure represented in FIG. 1 is schematic and, although typical, need not be exactly that utilized in an operative device. Thus, for example, a plurality of reheater tube bundles 16 may be interposed in series between inlet apertures 13 and outlet apertures 14. Each successive reheater will have hot steam supplied at higher pressures. Similarly the entire reheater structure including tube bundle 18, header assembly 19, including header 21 and tubesheet 20 may be included within shell 12. Alternatively, although a return pass configuration is shown wherein the steam in the heat exchange tubes 22 passes twice through the flow of shellside steam and passage may be simpler or complex. Thus, for example, the inlet header may be located at one end of the shell and the outlet header may be located at the opposite end of the shell and the tubes may make only a single pass through the shell 12 between inlet header chamber and outlet header chamber. On the other hand a complex header configuration may be utilized with plural baffles in the header assembly 19 so that a four, six, or greater number of passes of the steam may be made through differing portions of the tube bundle 18 so as to achieve greater efficiency of operation by the passage of the tubeside steam in heat transfer relationship with the shellside steam a plurality of times to cause a more equal distribution of scavenging steam for the majority of the tubes. Such modifications are well known in the art. One such specific multiple pass structure is discussed hereinafter.

FIG. 2 of the drawing illustrates in greater detail a vertical blow-up cross-sectional illustration of the reheater portion of the moisture separator reheater of FIG. 1 and specifically includes greater detail for the header assembly 19, the tubesheet 20, and end portions of the heat-transfer tubes 22. In FIG. 2 inlet header chamber 24 is connected to the inlet ends of tubes 22 and receives saturated tubeside steam from pipe 26 which is passed into tubes 22 through tubesheet 20. Tubes 22 after passage through the length of the shell (not shown) return to tubesheet 20 and the tubes discharge liquid condensate and steam into outlet header chamber 25.

In accord with this invention the heat exchanger tubes are orificed at the exit end thereof immediately adjacent the outlet header chamber thereby to regulate the flow of liquid condensate and tubeside steam from the heat exchanger tubes into the outlet header chamber. As is illustrated in FIG. 2 the orifices in the exit ends of the respective tubes are of differing size with the lowermost tube 30 (the most heavily loaded tube) having the least restricted orifice and a progressively decreasing size orifice in the progressively less heavily loaded tubes 32 through tube 34. The inlet ends of tubes 22 could or could not be also differentially orificed to balance steam flow through the respective tubes, as is conventional in the art.

The orificing of the outlet ends of the heat-transfer tubes is unique in that it presents a number of advantages in controlling instabilities in the operation of a shell and tube heat exchanger over orificing of the inlet end of the tube and provides for greater efficiency of heat transfer.

As is set forth hereinbefore the problems with which the invention is concerned are instabilities which may occur in the tube bundles of shell and tube heat exchangers due to subcooling of condensates formed by the heat exchange process and by the failure of all condensate formed in certain of the tubes to be completely removed from the exit ends of these tubes, even with moderate scavenging. The exact tubes in which the problem exists may vary depending upon the degree of loading. At full load it exists in the most heavily loaded tubes. The consequences of such instabilities are set forth in detail in the aforementioned copending application of Reed et al., Ser. No. 890,674, filed Mar. 27, 1978, now U.S. Pat. No. 4,206,802 and assigned to the present assignee. A further dissertation upon this problem is not needed since in addition to being thoroughly discussed in the aforementioned Reed et al. application it is well known to those skilled in the art.

The utilization of an excess amount of steam input to the inlet header chamber to purge or scavenge the condensate and steam from the most heavily loaded tubes is well known to the art but is inefficient in that the excess steam is, in the absence of orificing, to an unnecessary degree passed through lightly loaded tubes as well as heavily loaded tubes and thereby wasted. Such waste takes away from the efficiency of the heat exchanger and if utilized with a steam plant associated with a steam turbine detracts from the efficiency of the steam turbine. Conventional inlet orificing as is taught by U.S. Pat. No. 3,073,575 to Schulenberg and is utilized in the invention set forth in the aforementioned Reed et al application is a step in the right direction in that it tends to reduce the amount of excess or scavenging steam fed to the lightly loaded tubes of a tube bundle and directs this amount of steam to the more heavily loaded tubes of a tube bundle. Inlet orificing is, however, not a total answer in that, while decreasing the loss of efficiency inherent in the use of scavenging steam it causes a constant pressure drop across a given orifice for any given steam flow rate with a corresponding drop in saturation temperature. Additionally the pressure drop across a given inlet orifice does not vary greatly with steam pressure or with an individual tube's heat demand and furthermore a given inlet orificing technique is designed for optimum purposes only for a given load and its efficiency of operation falls off rapidly with a deviation of the load from the design load for which the orificing scheme is established.

Outlet orificing, on the other hand, has a number of advantages over inlet orificing. Such advantages include the following.

While inlet orificing serves only to equalize the flow in respective tubes in a shell and tube reheater, outlet orificing which (as is explained hereinafter) characteristically passes condensate in preference to steam, which is retained so long as liquid condensate is present in the tubes and maintains a high pressure of steam within the tubes and prevents steam in the outlet header chamber from backflowing into the tubes from the outlet header while condensate remains in the tube.

Another advantage results from the selective liquid emission characteristic of outlet orificing in that by placing the major pressure drop of lightly loaded tubes at the exit end of the tubes, the temperature of these tubes will be higher than if the pressure drop is at the entrance of the tubes. Higher temperatures within the heat-transfer tubulation, particularly at the first point of incidence of shellside steam with heat exchange tubes results in a greater efficiency of heat transfer and more effective reheating of shellside steam.

Due to the selective emission of the condensate present within the outlet end of heat exchange tubes the amount of steam in excess of that thermodynamically required to heat shellside steam which must be input to the heat exchange tubes (scavenging steam) in order to prevent instabilities is greatly reduced, thus eliminating thermodynamic losses due to use of excess scavenging steam.

Another advantage of outlet orificing over inlet orificing is that, due to the selective emission of condensate as opposed to vaporized steam within the heat exchange tubes, major oscillations due to condensate subcooling and reverse flow of condensate in the outlet end of the reheater tubes is substantially eliminated, instabilities and oscillations resulting therefrom are eliminated and the mechanical problems resultant therefrom are also eliminated.

Figure 7:
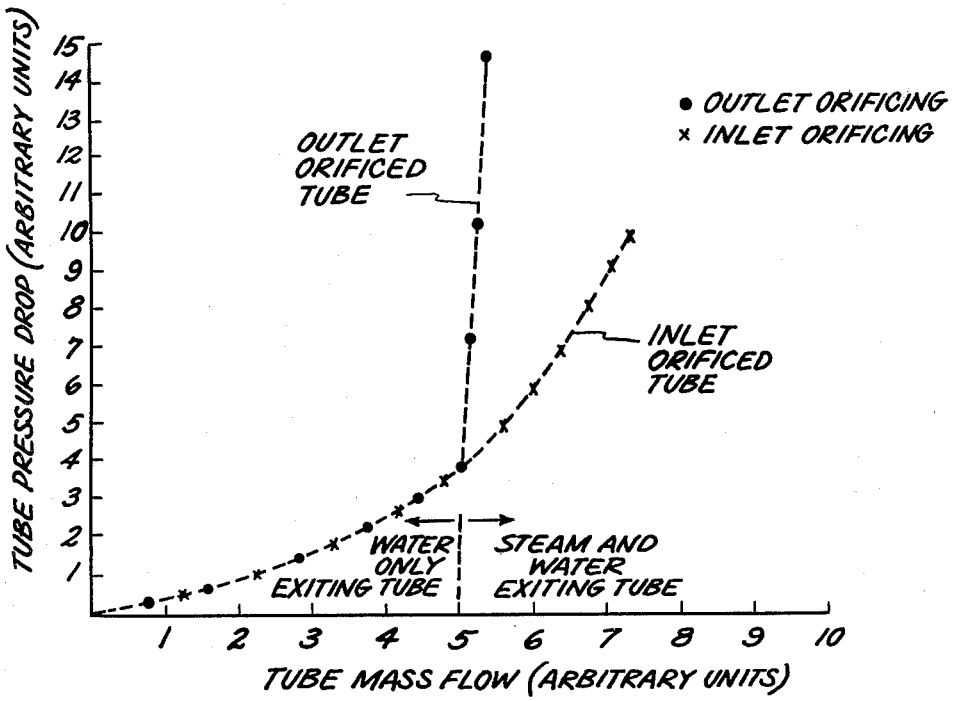
FIG. 7 is a graph showing performance curves of a heat exchanger in accord with the invention and which shows the improved characteristics of apparatus of the invention.

More specifically the advantages of outlet orificing in the heat-transfer tubes of a shell and tube reheater are largely related to the fact that the mass flow versus pressure drop characteristic of an outlet orifice is nonlinear. This characteristic is illustrated in FIG. 7. Thus, the pressure drop required to pass liquid and a liquid-vapor mixture, respectively, differ greatly. With liquid only being expelled from the outlet orifice a relatively low pressure drop is required due to the relatively small volume flow of liquid necessary to cause a given mass flow through the orifice as compared with the relatively large volume flow of vapor which would be required to cause the same mass flow through the orifice.

As is shown in FIG. 7, the pressure drop required to pass a liquid and vapor mixture is dramatically higher than that which is required to pass the same mass flow of liquid only. Simply put, this is due to the accelerating effect of the vapor on the liquid velocity. For example, for steam at 500 pounds per square inch pressure, approximately fifty times the volume of steam than the volume of water must be passed in order to obtain the same mass flow.

Since the pressure drop between the inlet header chamber and the outlet header chamber as illustrated in FIGS. 1 and 2 is a single value, all tubes are therefore subjected to the same system pressure drop and due to outlet orificing all tubes are similarly inhibited from expelling large quantities of scavenging steam.

Insofar as increased heat-transfer efficiency as a result of outlet orificing is concerned it logically follows that with the outlet orifice retaining a larger proportion of the tubeside steam pressure therein the average temperature of each tube is higher than it would be without outlet orificing. This temperature is not diminished due to excessive subcooling due to the selective expulsion of condensate from outlet orifices. With a higher average tube temperature a greater amount of heat is transferred to shellside steam since heat transfer is directly proportional to the temperature differential between the heat exchange tubes and the shellside steam in thermodynamic contact therewith.

With respect to the elimination of instabilities in the heat exchanger by the use of outlet orificing as mentioned hereinbefore the outlet orifices ensure rapid and selective ejection of liquid condensate from the outlet end of each tube. This is done on a steady-state basis due to a substantial pressure drop across each outlet orifice and the common pressure drop between the inlet and outlet headers which remains substantially constant. This is to be compared with the situation which may exist with inlet orificing and scavenging only wherein scavenging steam periodically causes accumulated subcooled condensate to be purged into the outlet header causing a significant decrease in outlet header chamber pressure which then begins to build up again as condensate accumulates in the more heavily loaded tubes to the point at which scavenging steam again causes a purging and a subsequent lowering of outlet header pressure giving rise to oscillations which can cause mechanical stresses upon the tubes in the tube bundle and possible mechanical failure due to such stresses.

Yet another advantage to outlet orificing as described herein and illustrated in FIG. 2 is that while inlet orificing is effective for a predetermined load condition due to a constant pressure drop characteristic across inlet orifices, outlet orificing is more effective over a broader range of operating load conditions since the pressure drop across outlet orifices is extremely sensitive to the passage of vapor at the ends of the tubes. Since this variable characteristic is present at all load points, the mass flow in a tube will be permitted to change to meet the varying demands of different loads. Since such changed characteristics improved vapor flow distribution, outlet orificing utilizing predetermined outlet orifices are effective to maintain a satisfactory control of the tubeside steam flow and to optimize the operation of the heat exchanger, or an MSR incorporating the same, over a much wider range of operating conditions than may be accomplished utilizing inlet orificing alone as is used in the prior art.

Since the illustrations of the orifices 35 through 38 in FIG. 2 are shown on a relatively small scale on enlarged partial diagrammatic sketch of tube 31 and outlet orifice 35 is shown in FIG. 3. As may be seen from FIG. 3, outlet orifice 35 constitutes a metallic insert in that portion of the tube 31 which is affixed within tubesheet 20. As an added improvement the orifice assembly including orifice 35 and insert tubulation 40 is inserted within tube 31. This has several advantages. The heat exchanger tubulation is most susceptible to failure due to the combined influences of mechanical and thermal stresses at that point at which it enters tubesheet 20 and is also over its entire length subject to erosion due to impurities contained within the tube by virtue of the tubeside steam passing therethrough. The impurities tend to be more highly concentrated in the liquid phase or condensate and thus tube 40 containing orifice 35 serves both as a reinforcement of the tubesheet enclosed portion of tube 31 and also as an erosion shield to protect that portion of the tube 31 included within tubesheet from erosion from impurities contained within the fluid passing therethrough, principally in a liquid form.

Figure 5:
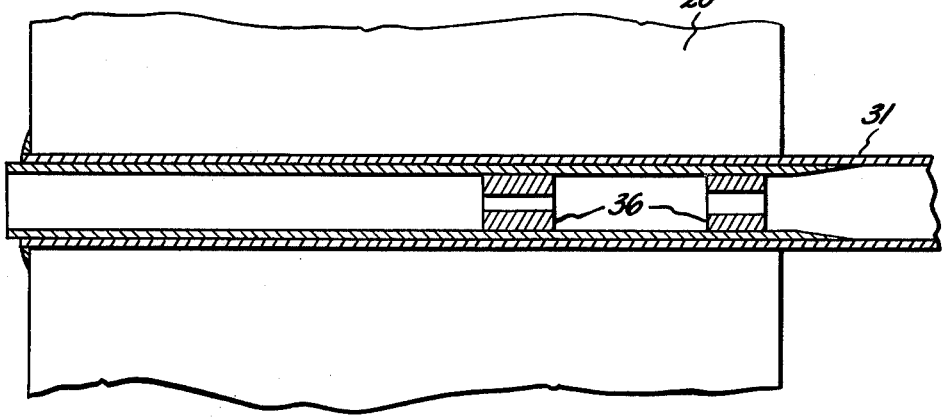
FIG. 5 is an alternative orificing apparatus to that shown in FIG. 4.

FIGS. 4 and 5 show alternative structures to that illustrated in FIG. 3. In FIG. 4 tube 31 passes through tubesheet 20 and is welded thereto at 41 or otherwise suitably affixed thereto. Orifice 35 contained in erosion shield 40 is inserted by a press-fit within the tubesheet portion of tube 31. In this embodiment a single orifice provides the appropriate orificing function as is described hereinbefore. In FIG. 5 erosion shield 40 extends throughout the tubesheet enclosed portion of tube 31 and contains a plurality of outlet orifices 35 in series relationship in lieu of the single orifice 35 of FIG. 4. It may be noted that the aperture within orifices 35 in FIG. 5 are both larger than the single orifice 35 in FIG. 3. Due, however, to the series flow relationship of the two orifices in FIG. 5, the two larger orifices, or any desired number of orifices, in series have the same throttling effect upon the condensate and steam and operate functionally the same as the single smaller orifice in FIG. 4. Since a smaller orifice is more likely to become obstructed or clogged with particulate inclusions in the tubeside steam, the use of a plurality of orifices in series having larger orifice diameters has the advantage of minimizing the possibility of clogging which would require repair or replacement thereof.

An additional advantage of the use of erosion shield 40 as illustrated in FIG. 3, FIG. 4 and FIG. 5 is that the orifice assembly including the orifices and the erosion shield may be inserted and removed readily thus permitting retrofit of already existing moisture separator reheater heat exchangers. Thus, even with heat exchangers which already contain inlet orificing which is ineffectual to completely control and optimize the thermodynamic operations of the heat exchangers therein, outlet orificing may be provided with or without the removal of the inlet orifice. Thus, the outlet orificing described herein and to which this invention is directed is not inconsistent with the simultaneous use of inlet orificing although in one embodiment of the invention the outlet orificing is utilized exclusively. Another advantage of the structure as illustrated in FIGS. 3, 4 and 5 is that for significantly changed load conditions, or to optimize the performance of a given heat exchanger or MSR in view of operating experience orificing may be changed without a significant amount of "downtime" of the moisture separator reheater, thus permitting optimized operation with minimal interruption of a power plant including moisture separator reheaters having heat exchangers utilizing the orificing schemes as disclosed herein.

As described hereinbefore the outlet orificing of the present invention has been described with respect to a two-pass system in which tubeside steam enters an inlet header chamber and therefrom is passed into all of the heat exchanger tubes of a given tube bundle exiting therefrom into a single outlet header chamber from which condensate is drained and excess steam is removed to be used for further useful work. In yet another embodiment of the invention the header structure may be modified so as to provide a multiple pass reheater heat exchanger.

Figure 6:
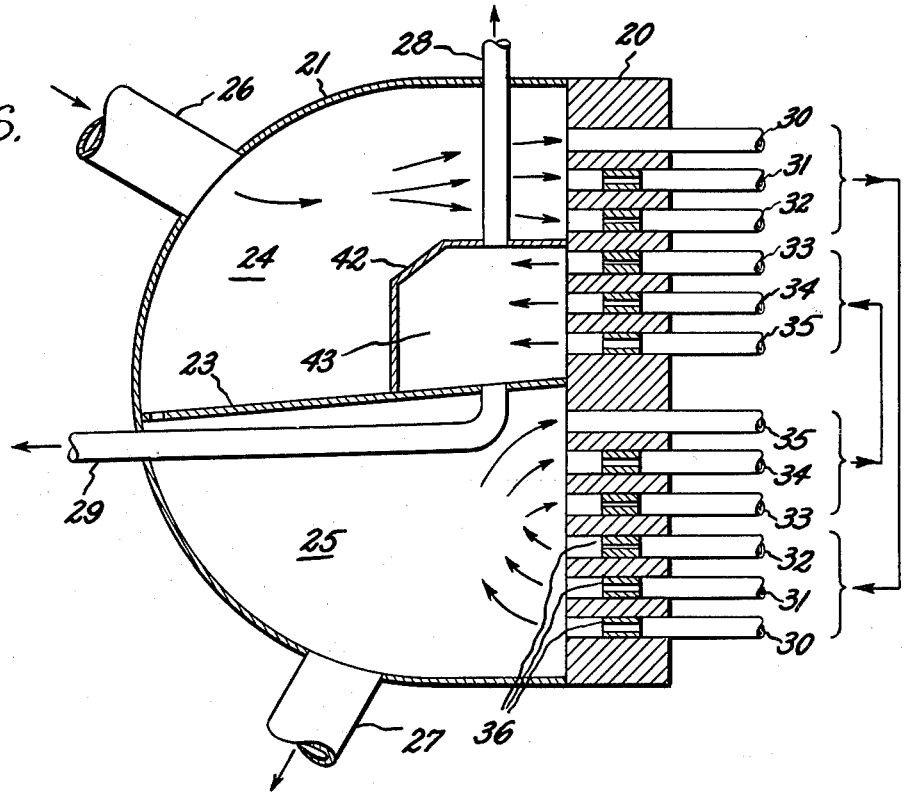
FIG. 6 is a partial vertical view of a header and tubesheet assembly illustrating the application of the invention to a four-pass reheater.

Such a modified header structure is illustrated in FIG. 6 of the drawing. In FIG. 6 a four-pass heat exchanger utilizing the same configuration of U-tubes as is illustrated in FIGS. 1 and 2 may be achieved by utilizing the modified header construction illustrated therein.

In FIG. 6 high-temperature, high-pressure saturated steam is input to the header assembly 21 from a throttle steam source (not shown) and enters inlet header chamber 24 through pipe 26. A partition assembly 42 within inlet header chamber 24 covers the inlet ends of heat exchanger tubes 33, 34 and 35 so that the initial path of the inlet steam is into the inlet end of tubes 30, 31, and 32 which may be inlet orificed as is conventional, but need not be. This steam traverses a U-type path such as is illustrated in FIGS. 1 and 2 and uncondensed steam and liquid condensate are exited into intermediate outlet chamber 25 through tubesheet apertures 36.

Since the entire inlet steam flow is introduced to tubes 30, 31, and 32, higher velocities and greater mass flow results in these tubes. Not all of this steam is condensed and therefore both liquid and vapor are readily input to the intermediate outlet chamber 25. Chamber 25 also serves as an inlet header chamber to the ends of heat exchanger tubes 33, 34 and 35 input thereto through tubesheet 20. A third pass of saturated high-pressure, high-temperature steam passes in a reverse direction from header chamber 25 into tubes 33–35 from intermediate header chamber 25. After traversing a reverse U-shaped path and partially condensing, steam input to these tubes from header chamber 25 exits into auxiliary outlet header chamber 43 from which steam may be exited through pipe 28 and condensate drained through pipe 29. Alternatively both steam and liquid may be removed by means of vent line 29. This four-pass configuration has been found under certain circumstances to have advantages over a two-pass configuration in terms of increased thermodynamic efficiency of the heat exchanger assembly at off design load conditions in a moisture separator reheater. Additionally, it has the advantage that a much greater volume of steam than is necessary for thermodynamic heat transfer from tubeside steam to shellside steam from tubes 30 through 32 being passed therethrough, the excess steam effectively scavenges any liquid condensate therefrom without having to have a significant amount of excess steam added thereto.

Under full load conditions the tubes 30–32, the most heavily loaded tubes are most likely to exhibit problems of condensate subcooling and related instabilities, and it is therefore important to place outlet orifices 36 in the outlet ends of tubes 30–32 as they pass into intermediate header chamber 25. Nevertheless, at part load conditions orifices should be placed in the outlet ends of tubes 33–35 since under such conditions they are more susceptible to instability problems. In order to cover all contingencies due to changing load conditions it is advantageous to outlet orifice both sets of tubes 30–32 and 33–35. The added outlet orifices not essential under any load condition are not detrimental.

The advantages gained in outlet orificing in a multiple pass heat exchanger such as may be used in a moisture separator reheater assembly as illustrated in FIG. 6 are the same as those achieved and described with respect to the embodiment illustrated in FIG. 2. Similar outlet orificing may be used for multiple pass heat exchangers of the shell and tube type utilizing different patterns of multiple pass heat exchangers for MSR structures.

Similarly, outlet orificing as is described herein, although specifically described with respect to a shell and tube heat exchanger, preferably for use in a moisture separator reheater, and having a vertical U-tube two-pass and four-pass configuration wherein the heat exchanger tubes are of U-shaped configuration and return to a header assembly directly under the outgoing leg of the tube, the invention is equally applicable to a horizontal U-tube configuration in which a U-tube returns to the header assembly adjacent in the same horizontal plane to the outgoing leg.

Such structure is illustrated for moisture separator reheaters having a two-pass configuration in U.S. Pat. No. 3,712,272 issued to Carnavos. The same patent illustrates a moisture separator reheater having a plurality of reheater structures contained therein and it is obvious that the present invention may advantageously be applied to such structures. Moisture separator reheaters using four-flow arrangements in a horizontal U-bend heat exchanger structure are disclosed and claimed in U.S. Pat. No. 3,996,897 issued to Josef Herzog and double-pass moisture separator reheaters utilizing a plurality of double-pass heat exchangers having horizontal U-bend configurations are illustrated in U.S. Pat. No. 3,744,459 issued to William G. Reed.

While the invention has been set forth herein with respect to certain preferred embodiments thereof and has been disclosed the practice of the invention in the best mode of operation, it is apparent that the invention is not limited to the specific configurations and examples set forth in the described embodiments and modes. Accordingly, it is intended by the appended claims to cover all such modifications and changes as fall within the true spirit and scope of this invention.

What is claimed is:

1. A shell and tube moisture separator reheater comprising:

(a) a shell having at least one wet shellside steam inlet opening in the lower side thereof operative to receive cool saturated shellside steam and at least one dry superheated shellside steam outlet opening in the upper side thereof operative to discharge hot superheated shellside steam;

(b) moisture separator means within said shell proxamate said inlet opening for removing entrained moisture from said saturated shell side steam;

(c) at least one reheater tube bundle having at least heat transfer tubes thereof located in said shell and including (c1) at least one inlet header chamber operatively connected to receive hot tubeside steam hotter than said shellside steam;

(c2) at least one outlet header chamber operatively connected to receive and discharge liquid condensate and excess tubeside steam;

(d) a plurality of U-shaped heat-transfer tubes in said shell in heat transfer relationship with said shellside steam and operative to transfer heat to said shellside steam by condensation of a portion of the tubeside steam therein whereby liquid condensate is deposited therein, said heat transfer tubes being subjected to differing thermodynamic loading, the more heavily loaded thereof having deposited therein the greater amount of liquid condensate;

(d1) at least one portion of said heat-transfer tubes being in fluid flow relationship with said inlet header chamber and operative to receive therefrom hot tubeside steam;

(d2) at least a portion of said heat-transfer tubes being in fluid flow relationship with said outlet header chamber and operative to transfer thereto condensate and excess tubeside steam; and (e) discrete restricted diameter orifices located within said heat-transfer tubes adjacent said outlet header chamber for controlling the flow of condensate and shellside steam from said tubes to said header and preferentially pass liquid condensate therefrom, said orifices providing different size outlet apertures in different heat transfer tubes in accord with the different thermodynamic loading thereof.

2. The moisture separator heat exchanger of claim 1 wherein all of said reheater tubes are connected between said inlet header chamber and said outlet header chamber.

3. The moisture separator heat exchanger of claim 2 wherein respective heat exchanger tubes are in a vertical plane.

4. The moisture separator heat exchanger of claim 1 wherein the inlet end of only a portion of said heat exchanger tubes are in fluid flow relationship with said inlet header chamber and the outlet ends of only a portion of said heat exchange tubes are in fluid flow relationship with said outlet chamber, said outlet header chamber also serving as an inlet chamber for other heat exchange tubes to provide at least a four-pass configuration for tubeside steam flow.

5. The moisture separator heat exchanger of claim 4 wherein outlet orifices are provided in the outlet end of the portion of said heat exchange tubes which carry the second pass of tubeside steam through said shell.

6. The moisture separator heat exchanger of claim 5 wherein outlet orifices are provided in the outlet end of the portion of said heat exchanger which carries the final pass of tubeside steam through said shell.

7. The apparatus of claim 6 wherein the heat-transfer tubes having outlet orifices therein are at least those which are the most heavily thermally loaded tubes in said reheater heat exchanger.

8. A moisture separator reheater operative to demoisturize and superheat exhaust steam from a first steam turbine stage prior to its passage to a second turbine stage and comprising:

(a) a shell having at least one wet shellside steam entrance opening in the lower portion thereof and at least one superheated steam outlet opening at the top portion thereof;

(b) a moisture separator adjacent said entrance opening operative to remove entrained moisture from said wet shellside steam;

(c) at least one reheater heat exchanger stage having at least the heat exchange tubes thereof located within said shell between said moisture separator and said outlet opening in said shell operative to superheat shellside steam after removal of moisture therefrom;

(d) said reheater heat exchanger having an inlet header chamber, an outlet header chamber and a plurality of U-shaped heat exchange tubes in heat exchange relationship with said shellside steam and in fluid flow relationship between said inlet header chamber and said outlet header chamber;

(e) means supplying saturated tubeside steam at a temperature higher than that of said shellside steam to said inlet header chamber and into inlet ends of at least some of said heat exchange tubes wherein during passage therethrough heat is transferred to said shellside steam by the condensation of some of said steam within said tubes causing the production of liquid condensate therein and liquid condensate and tubeside steam is delivered to said outlet header chamber, said reheater tubes being subjected to different thermodynamic loading, the more heavily loaded ones thereof having deposited therein the greater amount of liquid condensate; and (f) discrete restricted diameter outlet orifices located within the outlet end of said reheater tubes receiving steam from said inlet header chamber adjacent said outlet header chamber providing a restricted exit therefrom to preferentially pass liquid condensate therethrough and ensure drawing of liquid condensate from said tubes but also permitting exit of some uncondensed steam therefrom to said outlet header, said orifices providing different size outlet apertures in different heat transfer tubes in accord with the different thermodynamic loading thereof.

9. The apparatus of claim 8 wherein all of said heat-transfer tubes have outlet orifice means in the ends thereof adjacent said outlet header.

10. The apparatus of claim 8 wherein at least some of said heat-transfer tubes having outlet orifices therein also have inlet orifice means to provide a progressively greater mass flow of tubeside steam through the most heavily loaded heat-transfer tubes.

11. The apparatus of claim 8 wherein said inlet header chamber and outlet header chamber are at the same end of said shell and said heat-transfer tubes have a U-shaped configuration and traverse said shell twice.

12. The apparatus of claim 11 wherein said U-shaped heat-transfer tubes are located in a substantially vertical plane.

* * * * *